US005400121A

United States Patent [19]

Foote

[11] Patent Number: 5,400,121

[45] Date of Patent: Mar. 21, 1995

[54] BELT-TYPE PHOTOCONDUCTOR REPLACEMENT APPARATUS

[75] Inventor: Wayne E. Foote, Eagle, Id.

[73] Assignee: Hewlett-Packard Company, Palo Alto, Calif.

[21] Appl. No.: 163,318

[22] Filed: Dec. 7, 1993

[51] Int. Cl.[6] ..... G03G 5/00; G03G 21/00

[52] U.S. Cl. ..... 355/212; 206/303

[58] Field of Search ..... 355/200, 211, 212, 213; 206/303, 389

[56] References Cited

U.S. PATENT DOCUMENTS

| | | | |
|---|---|---|---|
| 3,888,577 | 6/1975 | Meyer | 355/200 |
| 4,551,001 | 11/1985 | Yokota | 355/212 |
| 4,655,578 | 4/1987 | Kurtz et al. | 355/212 |
| 4,766,455 | 8/1988 | Carter | 355/212 |
| 4,804,993 | 2/1989 | Kenin et al. | 355/212 |
| 4,811,839 | 3/1989 | Cornell et al. | 206/303 |
| 4,829,334 | 5/1989 | Takamatsu et al. | 355/211 X |
| 4,983,146 | 1/1991 | Charles et al. | 355/212 X |
| 5,243,384 | 9/1993 | Everdyke et al. | 355/212 |
| 5,307,117 | 4/1994 | Harlan | 355/200 |

*Primary Examiner*—Fred L. Braun

[57] ABSTRACT

An expandable shell for changing a belt-type photoconductor in an image forming apparatus such as a laser printer. The apparatus has a two piece expandable housing which captures the belt around the housing's inner wall. Guide features are provided on each half of the housing to ensure proper belt placement. Mating guide features are located in the image forming apparatus. The guide feature in the printer nearest the idler roller is linked to the idler roller which is movable toward the drive roller to facilitate changing the belt. The belt is captured in the housing when the housing is in the collapsed position. When the housing expands, the belt becomes free from the housing and is captured by the drive and idler rollers in the printer.

8 Claims, 14 Drawing Sheets

BELT-TYPE PHOTOCONDUCTOR REPLACEMENT APPARATUS

BACKGROUND OF THE INVENTION

1. Technical Field

This invention generally relates to image forming devices employing belt-type photoconductors. More particularly, this invention relates to a device for installation and removal of a belt photoconductor in and from an image forming device.

2. Background Art

When using a belt as a photoconductor in a laser printer, a method to replace the belt must be provided since the belt has a life shorter than the life of the printer. One previous method to accomplish this operation uses cartridges that contain the belt along with rollers and a belt tensioning mechanism. This is an expensive way to replace the belt, since many other components are replaced along with the belt. Other methods replace only the belt. With these methods handling damage to the belt is likely during replacement. Excess toner can also be held on the belt surface creating a messy operation for the person doing the belt replacement.

SUMMARY OF THE INVENTION

This invention consists of a two piece expandable housing which captures the belt around the housing's inner wall. Guide features are provided on each half of the housing to insure proper belt placement. Mating guide features are located in the printer. The guide feature in the printer nearest the idler roller is linked to the idler roller. The belt is captured in the housing when the housing is in the collapsed position. When the housing expands, the belt becomes free from the housing and is captured by the drive and idler rollers in the printer.

The old belt is first removed from the printer with the aid of the clam shell housing. The housing is slid into the printer with the housing in its extended position. The housing is guided by track like features around its perimeter and mating features in the printer. When fully inserted, the housing completely surrounds the belt but does not touch it. The belt is then untensioned by moving the idler roller towards the drive roller. A simple cam operated mechanism could be used to untension the belt. The mechanism used to untension the belt also moves the clam shell housing half surrounding the idler roller a distance equal to the distance the idler roller moves. As the roller moves to untension the belt, the idler roller and the housing collapses, moving in unison. This motion causes the belt to move from being tensioned on the rollers to being held to the inner wall of the clam shell housing. The housing with the captured belt is then pulled from the printer. The old belt is then removed from the housing and a new belt is inserted into the housing. The housing is then re-inserted into the printer, but this time in its collapsed or contracted position. The mechanism used to untension the belt is also used to re-tension the belt and expand the housing. The housing is then removed from the printer.

This invention provides the same ease of belt replacement using a cartridge, only at a much lower cost. Similar to a replaceable cartridge, this invention also provides protection to the belt and to the operator.

DETAILED DESCRIPTION OF THE INVENTION

Referring now to the Figures, an expandable shell for changing photoconductive belts is shown being generally designated as 10 and is described in detail in the following description. Expandable shell 10 is formed to closely conform to the shape of a photoconductor belt 1 when belt 1 is installed over the drive roller 3 and the idler roller 4 in an image forming apparatus, such as a laser printer. Here, this shape has rounded ends, one of a smaller diameter than the other, with top and bottom panels, 11 and 12, connecting the two ends to form a tapered construction. In this preferred embodiment, expandable shell 10 is a two piece construction manufactured by injection molding a suitable plastic material such as polyethylene. It should be noted that other materials, constructions and methods of manufacture can be employed.

Figure 1:
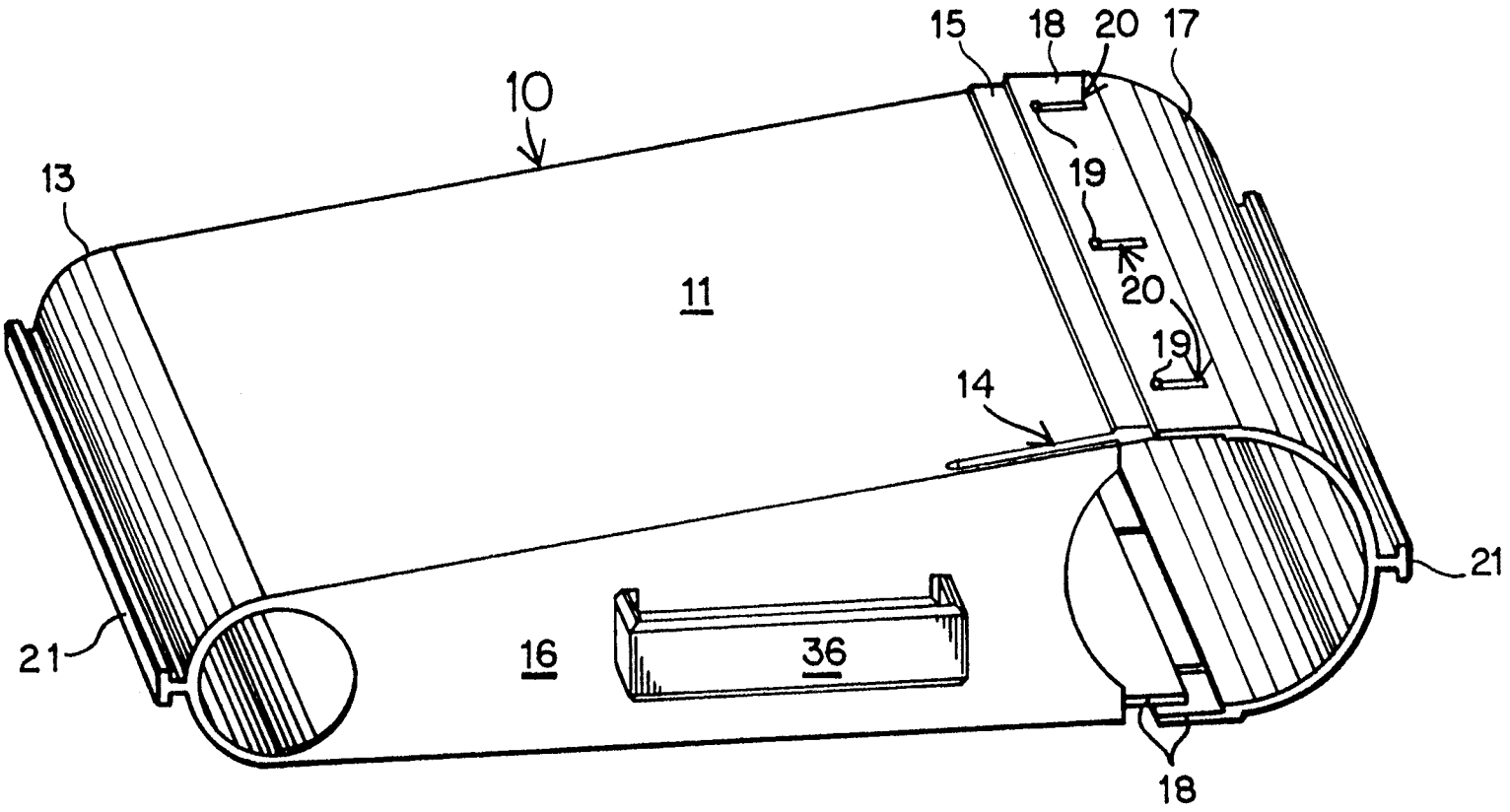
FIG. 1 is a front isometric view of the expandable shell for changing photoconductive belts in an image forming apparatus.
Figure 2:
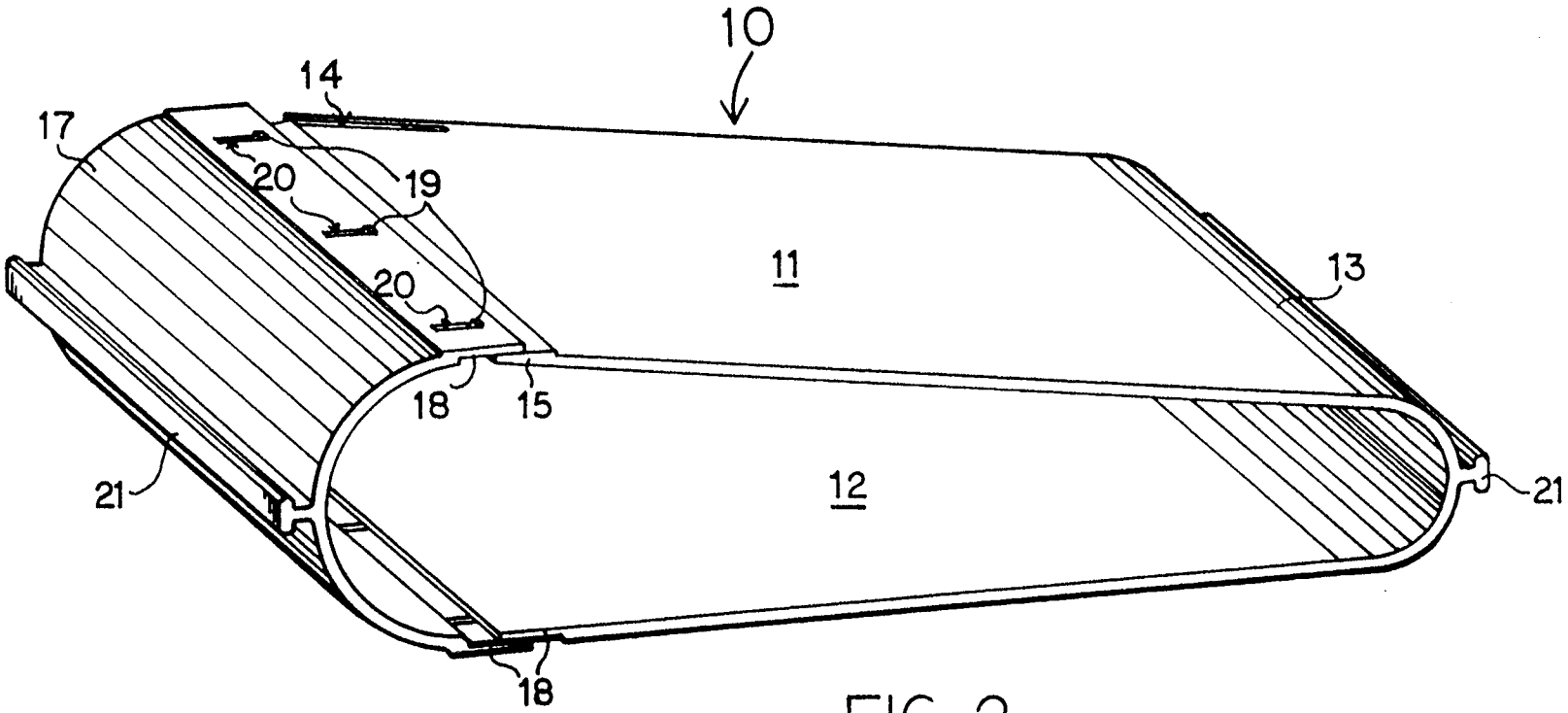
FIG. 2 is a back isometric view of the expandable shell for changing photoconductive belts in an image forming apparatus.
Figure 3:
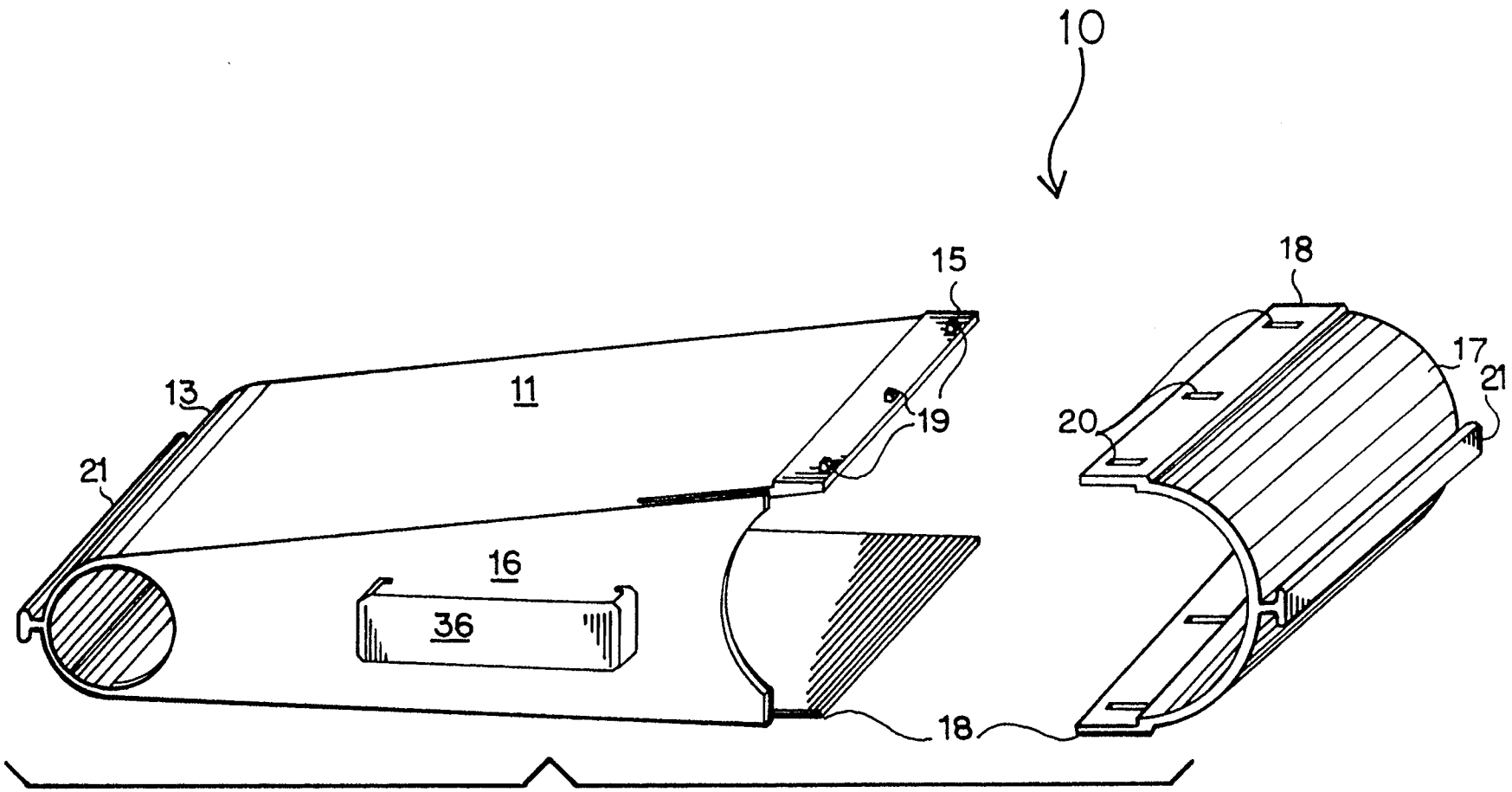
FIG. 3 is an exploded isometric view of the expandable shell for changing photoconductive belts in an image forming apparatus.
Figure 4A:
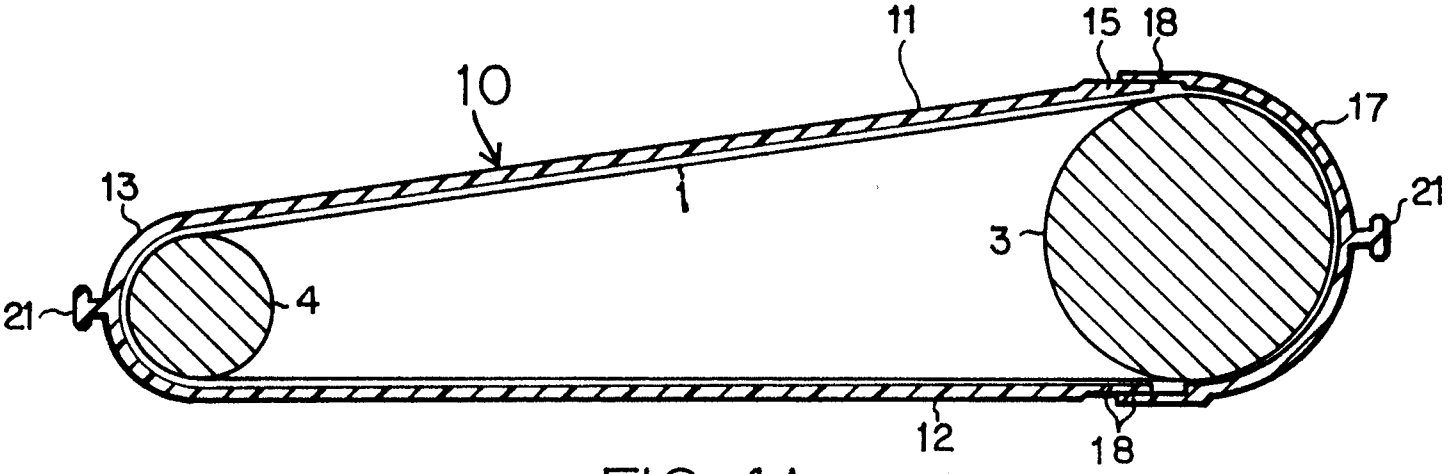
FIGS. 4A, 4B, 4C, 4D, 4E and 4F are schematic representations illustrating the steps involved in replacing a belt photoconductor using the expandable shell.
Figure 4B:
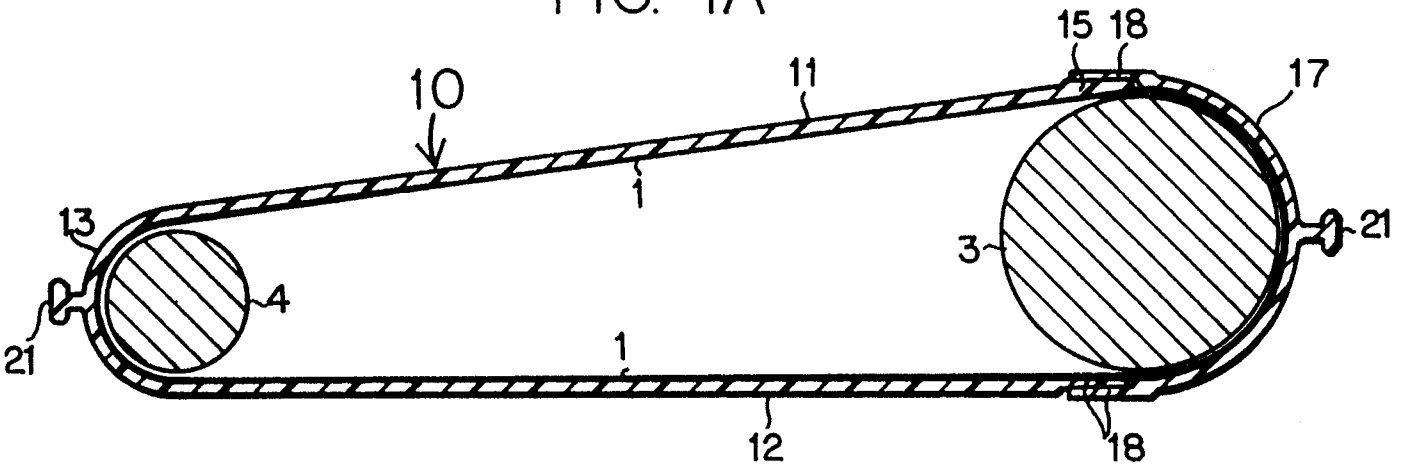
Figure 4C:
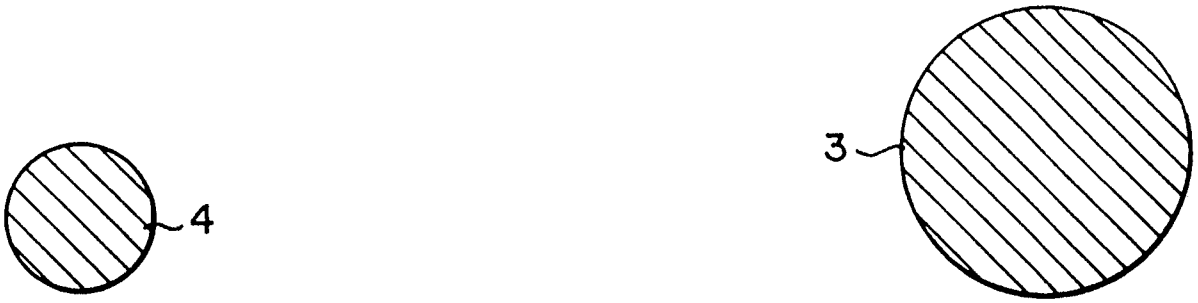
Figure 4D:
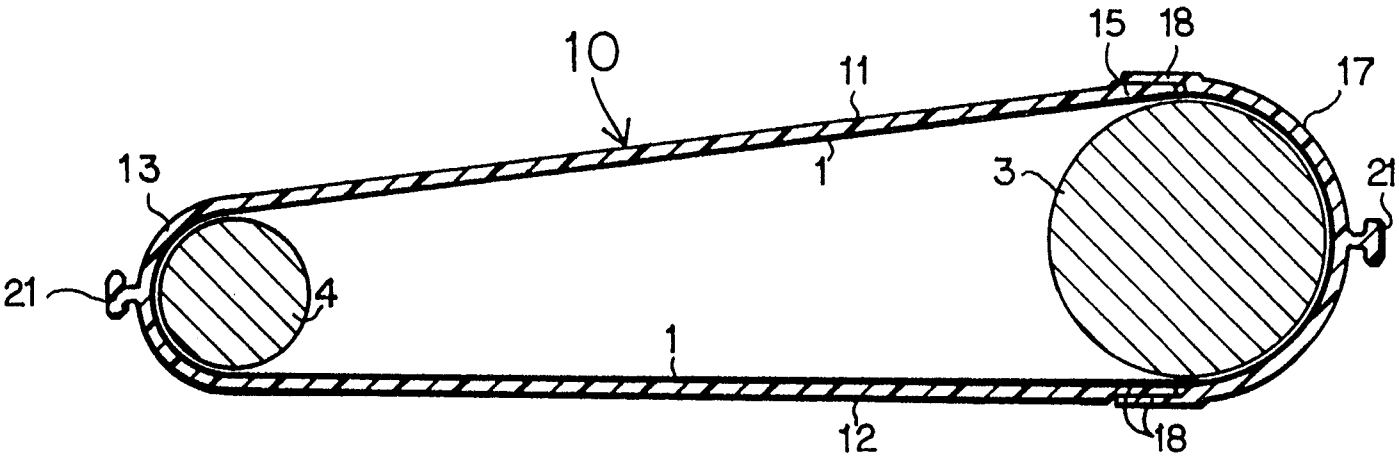
Figure 4E:
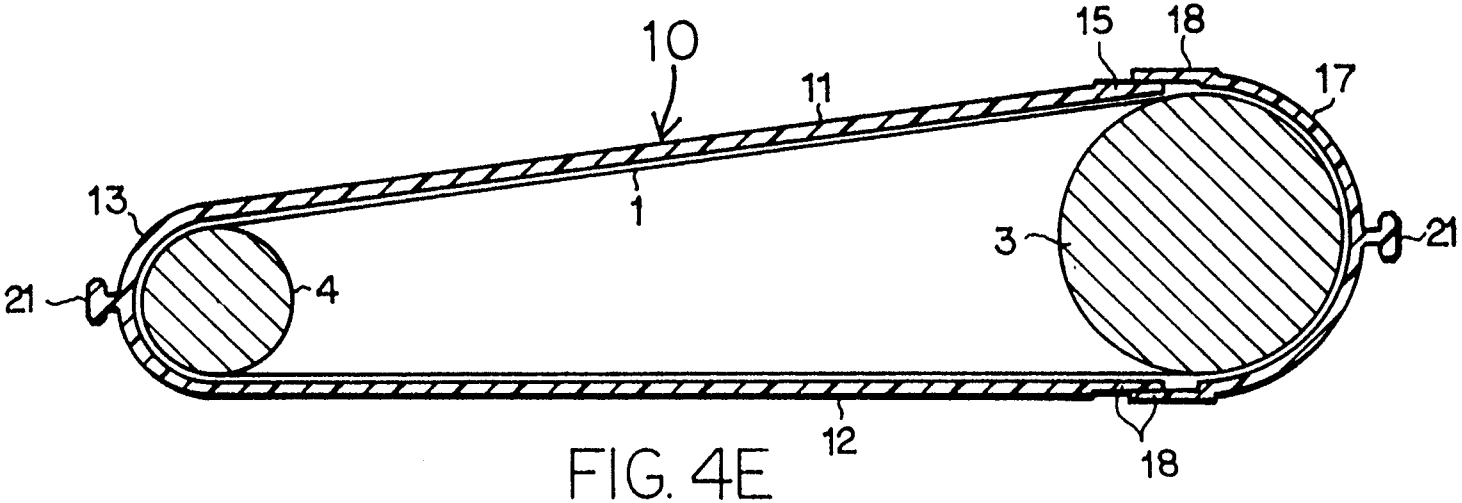

Large radius rounded end 17 is slidably attached to top panel 11 and bottom panel 12 between an expanded position, such as that shown in FIGS. 4A and 4E, and a contracted position, such as that shown in FIGS. 4B and 4D. This is accomplished by expansion nub slots 20, formed in straight expansion flanges 18 on rounded end 17. The two straight expansion flanges 18 on rounded end 17 are formed along diametrically opposed edges of the cylindrical section which constitutes the main body of rounded end 17.

Expansion nub slots 20 are sized and positioned to slidably receive expansion nubs 19, which protrude outward from a straight expansion flange 18 on bottom panel 12 and a tapered expansion flange 15 on top panel 11. A slight downward flexing of top panel 11 is required to snap rounded end 17 onto the main shell body, formed by top panel 11, bottom panel 12, small radius rounded end 13 and front panel 16. Front panel 16 spans between the two front edges of top panel 11 and bottom panel 12 and connects the two panels to form a rigid structure. However, a flex relief slot 14 is formed part way along the connection between front panel 16 and top panel 11 at the end of front panel 11 which has the tapered expansion flange 15.

Relief slot 14, in conjunction with tapered flange 15, operates to constrict shell 10 around belt photoconductor 1 when rounded end 17 is forced into its contracted position. A handle 36 is formed on front panel 16 to facilitate installation and removal of shell 10 on and from a belt photoconductor in an image forming apparatus.

A pair of rails 21 are formed along the length of both small radius rounded end 13 and large radius rounded end 17. Rails 21 run along lines parallel to the axes of the arcuate sections of rounded ends 13 and 17 and lines which approximately bisect the cylindrical sections. Actually, the line defining the rail formed on large radius end 17 intersects the arc at a point slightly less than 0°, while the line defining the rail formed on the small radius end intersects that arc at a point slightly less than 180°. This positioning of rails 21 compensates for the fact that when shell 10 is installed on a belt in an image forming apparatus, bottom panel 12 is essentially horizontal, which is, here, also the direction of expansion and contraction. Otherwise, if rails 21 were not parallel with the direction of expansion and contraction, slight binding may occur. The cross sections of rails 21 are here generally "T" shaped to matingly engage stationary shell guide 22 and slidable shell guide 23. The cross-sectional shapes of rails 21 can be varied, for instance, using an "L" shape or a dove tail shape, with corresponding alterations in the guide slots of stationary shell guide 22 and slidable shell guide 23.

Additional modifications to shell 10 can be implemented, including the positioning of rails 21 along lines which don't necessarily bisect the cylindrical sections, or providing multiple or single shorter rails. In fact, the rails could be single or multiple mushroom shaped, or similar shaped, pins. Also, the radii of rounded ends 13 and 17 is dependent upon the radii of idler roller 4 and drive roller 3, respectively. Further, a tapered flange and flex relief slot can be provided on bottom panel 12 if desired. Additionally, a small ridge can be formed to circumvolve the inner marginal back edge of the housing to interact with the back edge of the belt and facilitate belt removal. Other modifications are possible.

One possible mechanism for expanding and contracting expandable shell 10 uses a fixed or stationary shell guide 22 and a movable shell guide or slidable shell guide 23 in connection with an idler roller 4 which is movable toward drive roller 3 to facilitate belt installation and removal. As is more thoroughly explained below, slidable shell guide 23 is linked to idler roller 4 to move in unison with idler roller 4 causing shell 10 to contract and expand.

Stationary shell guide 22 is fixed to printer support frame 2 at a point along the general line of expansion and contraction of shell 10. Slidable shell guide 23 is slidably secured within guide retainer 24, which is fixed to printer support frame 2 at an opposing point along the general line of expansion and contraction. Slidable shell guide 23 has a rectangular through hole 37 along its length. The cross-sectional width dimension of rectangular through hole 37 is equal to the diameter of expansion shaft 26 plus the distance required to move shell 10 from its fully expanded position to its contracted position.

This movement is facilitated by an expansion cam 25 formed along a substantial portion of the length of expansion shaft 26, but still within rectangular through hole 37. Expansion cam 25 is here generally triangular in shape. Cam 25 is formed off-center from the axis of rotation of shaft 26 such that the flat portion of cam 25 rests against the inner wall of rectangular through hole 37 closest to idler roller 4. A rotation of expansion shaft 26 in either direction will cause the lobe portions of cam 25 to push slidable shell guide 23 toward drive roller 3.

An activation lever 27 is radially attached to the front end of expansion shaft 26. An activation pulley 28 is concentrically attached to the back end of expansion shaft 26. A tension belt 29 rotationally couples activation pulley 28 with a tension pulley 30, attached to the back end of tension shaft 31, for reasons which will become apparent below.

Drive roller 3 is rigidly attached to drive shaft 5, which in turn is attached to a drive mechanism, not shown. Drive shaft 5 has a fixed position with respect to printer support frame 2 and will only rotate about the axis of the shaft. A pair of tension guide members 34 are rotatably attached around opposing ends of drive shaft 5 so that drive shaft 5 can rotate with respect to tension members 38. Tension guide members 34 act as slide receivers for a pair of tension slides 33. Tension slides 33 are rotatably attached to the ends of idler roller shaft 6 so that idler roller 4 can rotate with respect to tension slides 33. A pair of tension springs 35 interact between slides 33 and guides 34 to bias idler roller 4 toward the belt tension position which corresponds to the expanded position of shell 10.

Tension shaft 31 has a tension unload cam 32 formed along a substantial portion of its length and is positioned to interact with tension slide members 34 to untension and re-tension belt 1. With both the shell and idler roller in their expanded positions, a rotation of activation lever 27 in either direction will cause belt 1 to be untensioned and shell 10 to contract in unison. A reverse rotation of activation lever 27 will re-tension belt 1 and expand shell 10.

Figure 4F:
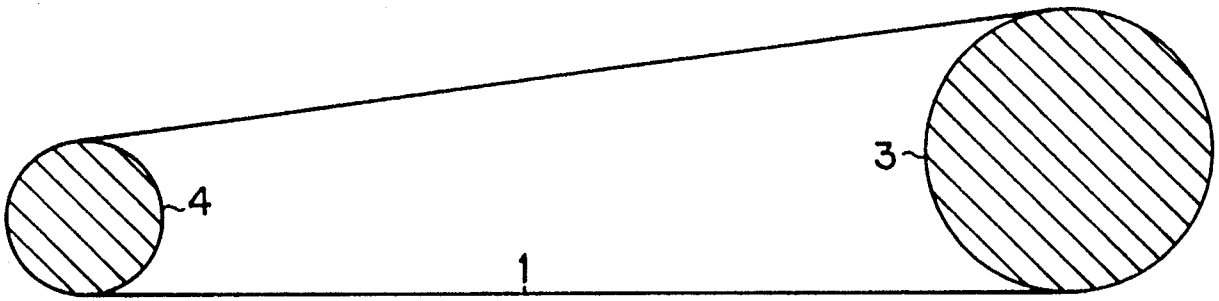
Figure 5:
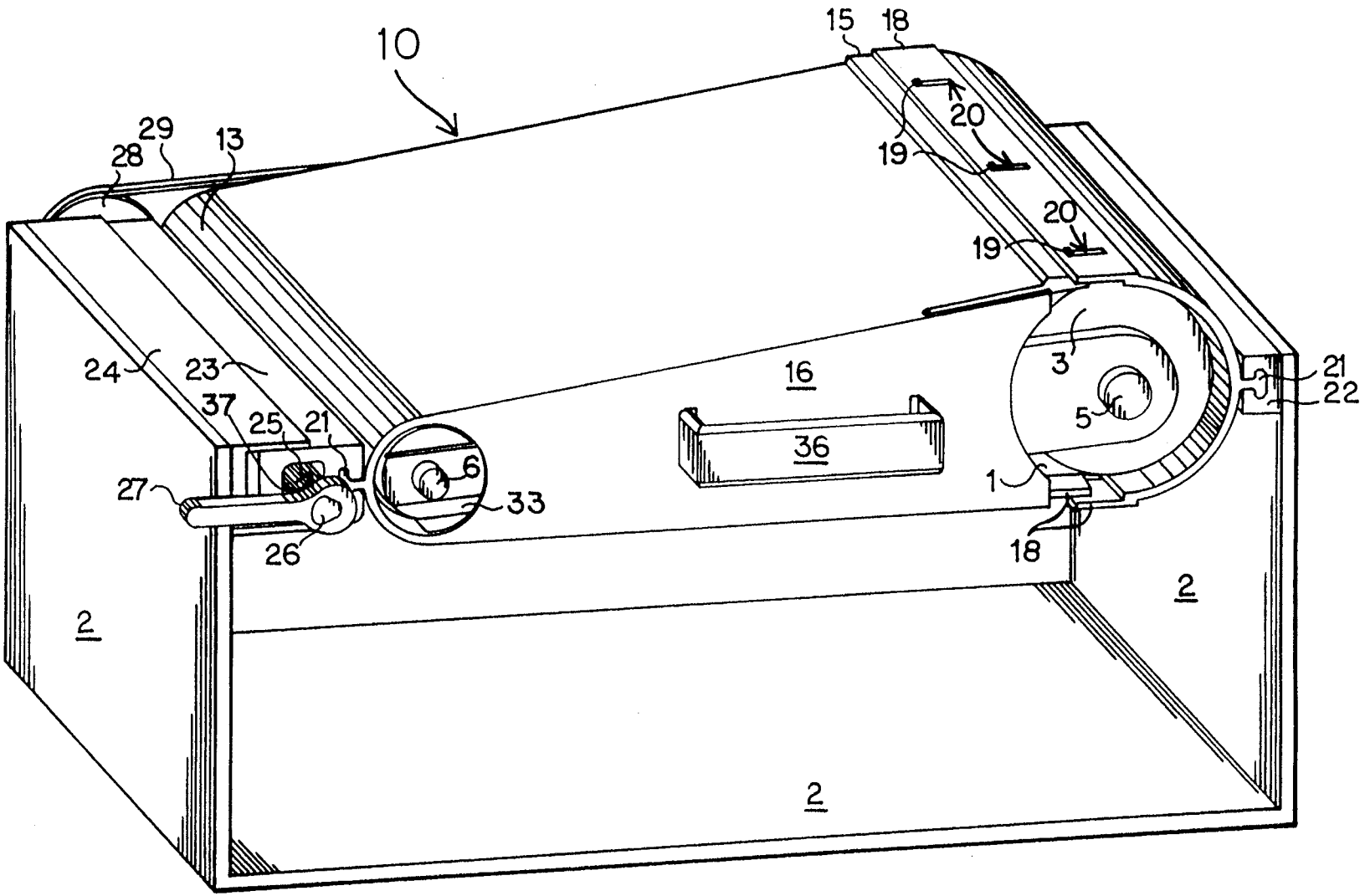
FIG. 5 is a front isometric view of the expandable shell for changing photoconductive belts, including a mechanism for expanding and contracting the shell, installed on a belt photoconductor in an image forming apparatus.
Figure 6:
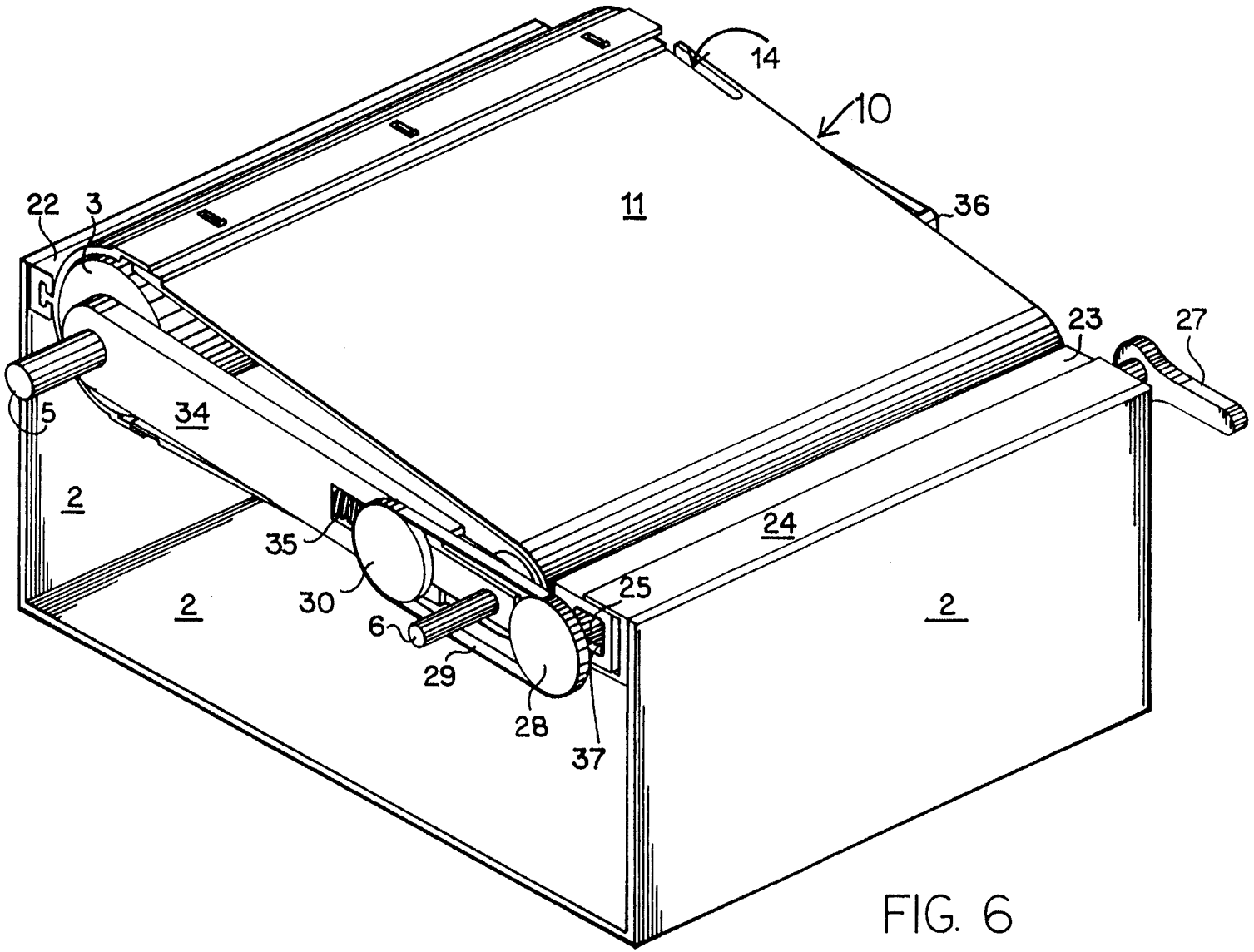
FIG. 6 is a back isometric view of the expandable shell for changing photoconductive belts, including a mechanism for expanding and contracting the shell, installed on a belt photoconductor in an image forming apparatus.
Figure 7:
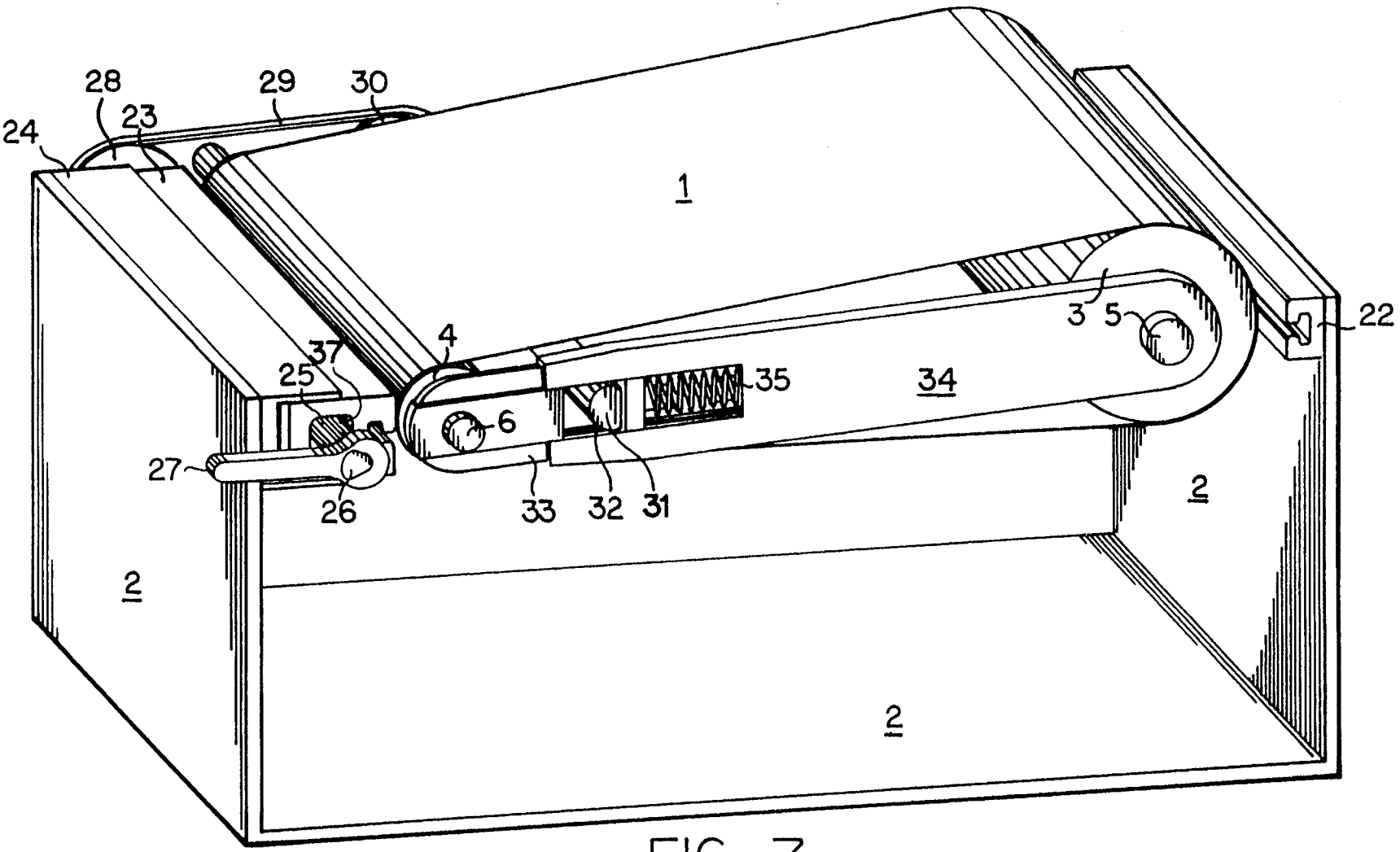
FIG. 7 is a front isometric view of the mechanism for expanding and contracting the shell, printer support frame and the drive and idler rollers, having a belt photoconductor installed thereon.
Figure 8:
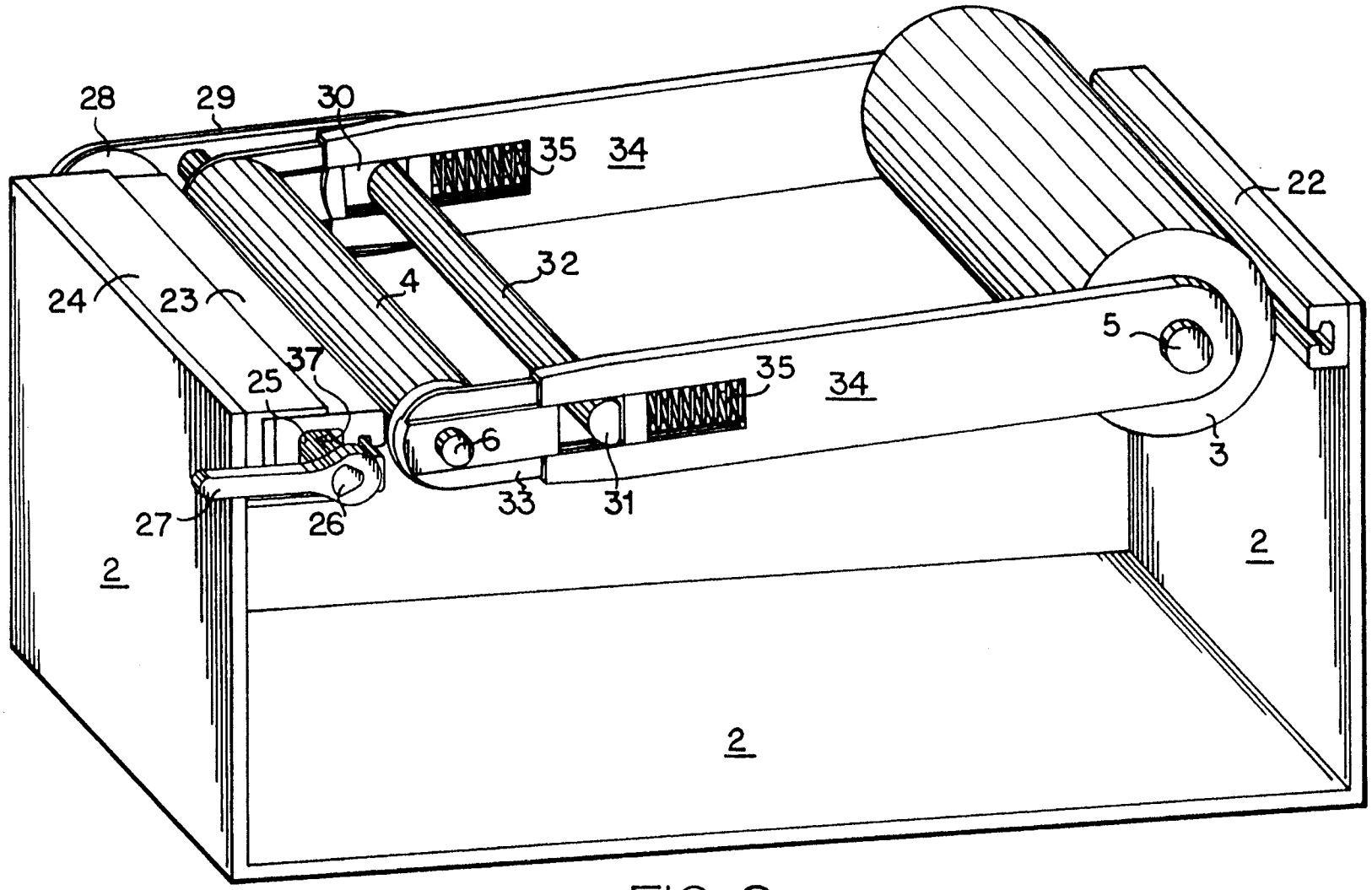
FIG. 8 is a front isometric view of the mechanism for expanding and contracting the shell, printer support frame and the drive and idler rollers, without the belt photoconductor installed.
Figure 9:
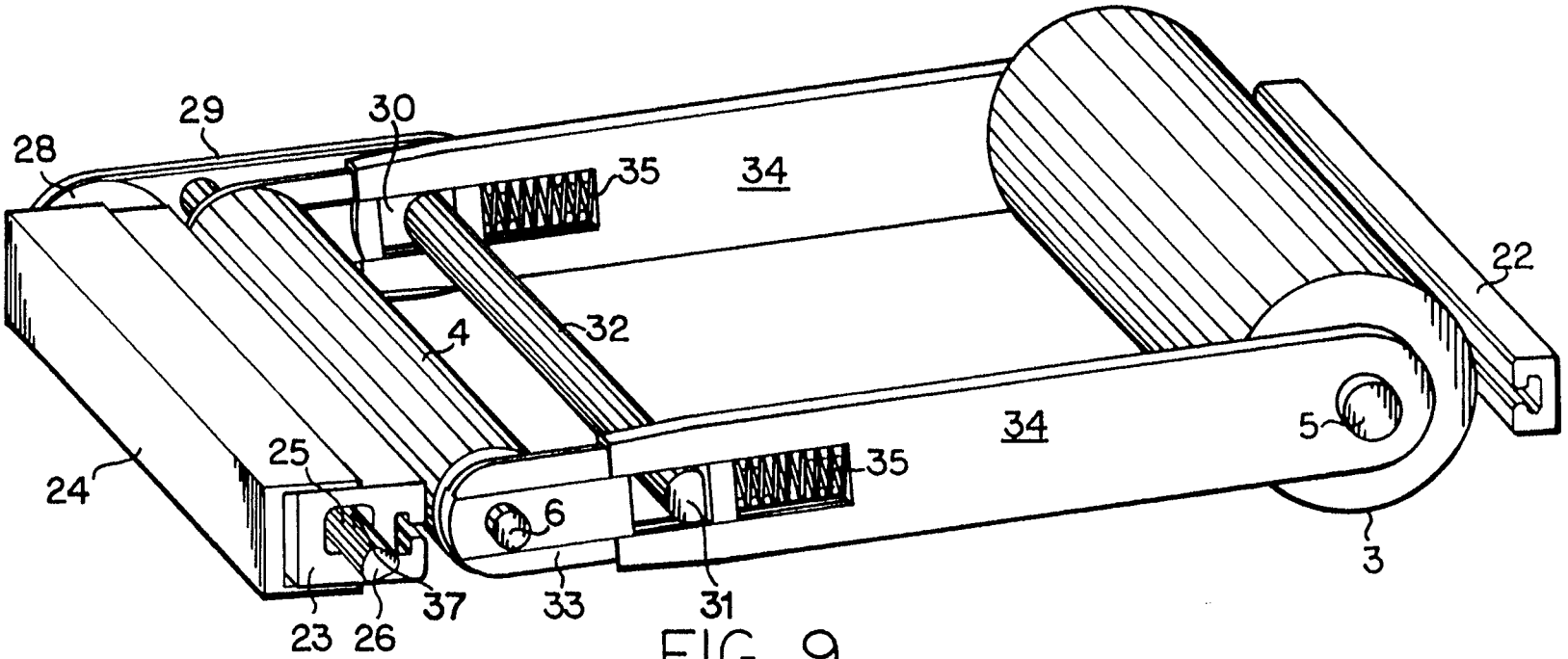
FIG. 9 is a front isometric view of the mechanism for expanding and contracting the shell and the drive and idler roller, without the belt photoconductor installed.
Figure 10:
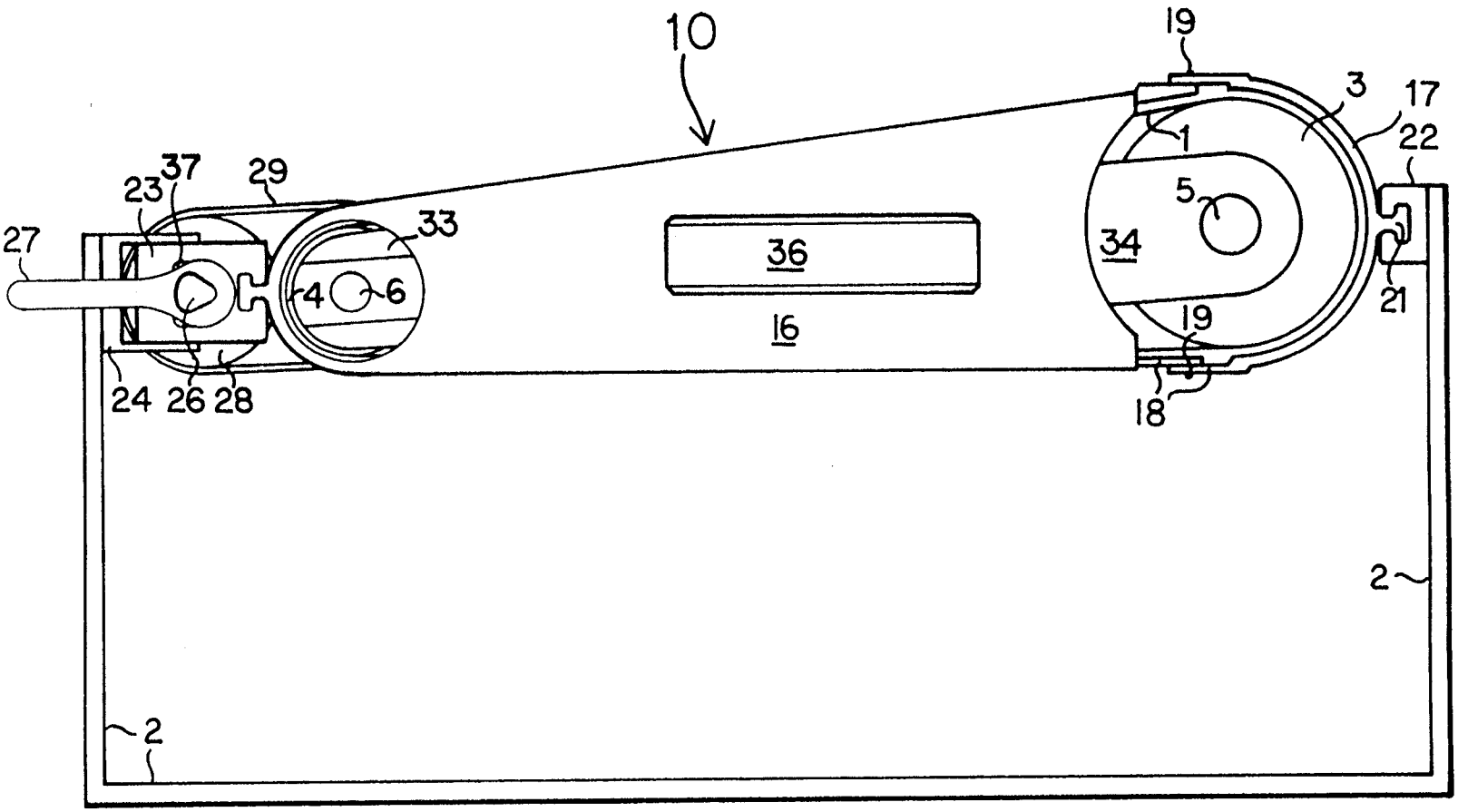
FIG. 10 is a front view of the expandable shell for changing photoconductive belts, including a mechanism for expanding and contracting the shell, installed on a belt photoconductor in an image forming apparatus.
Figure 11:
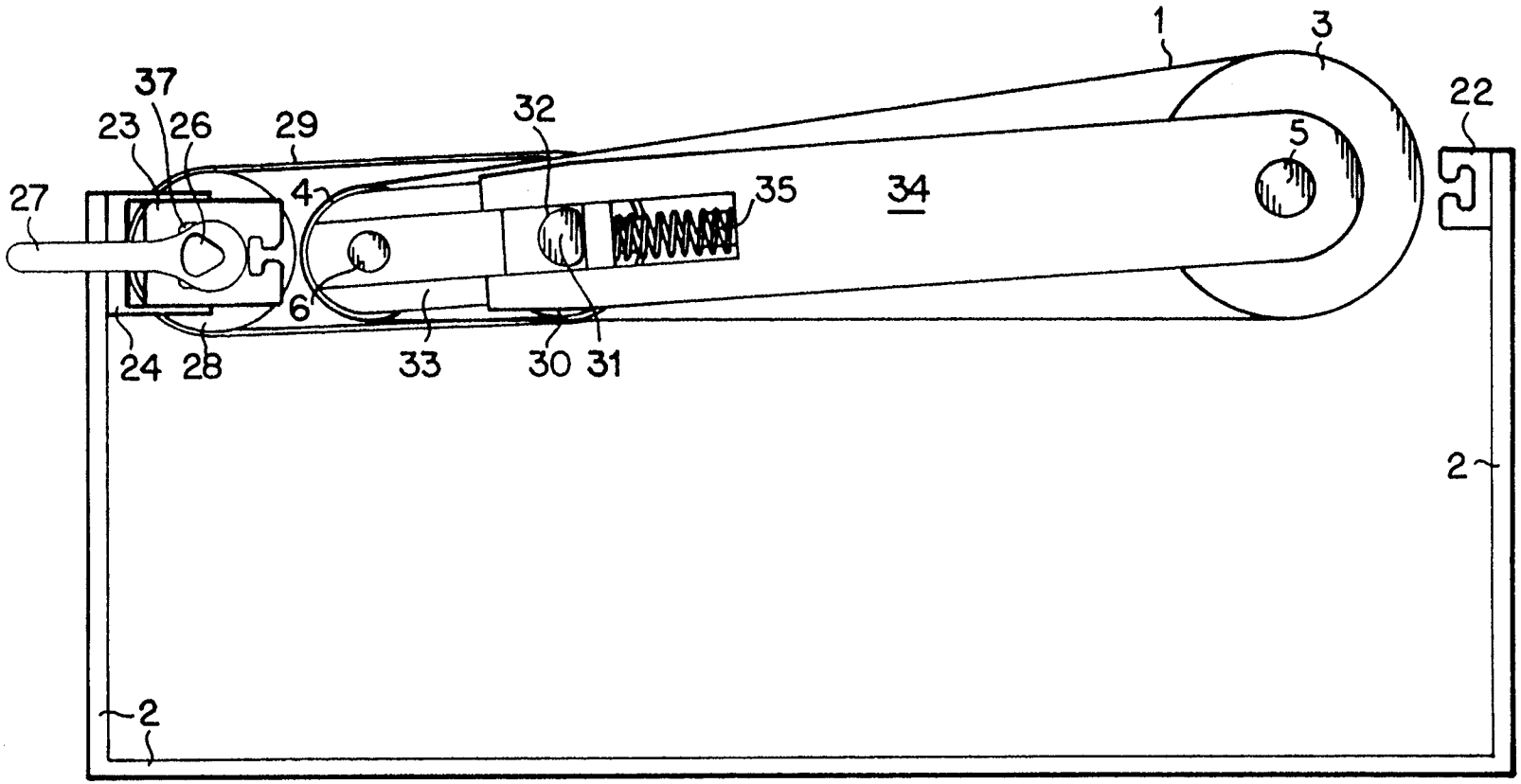
FIG. 11 is a front isometric view of the mechanism for expanding and contracting the shell, printer support frame and the drive and idler rollers, having a belt photoconductor installed thereon.
Figure 12:
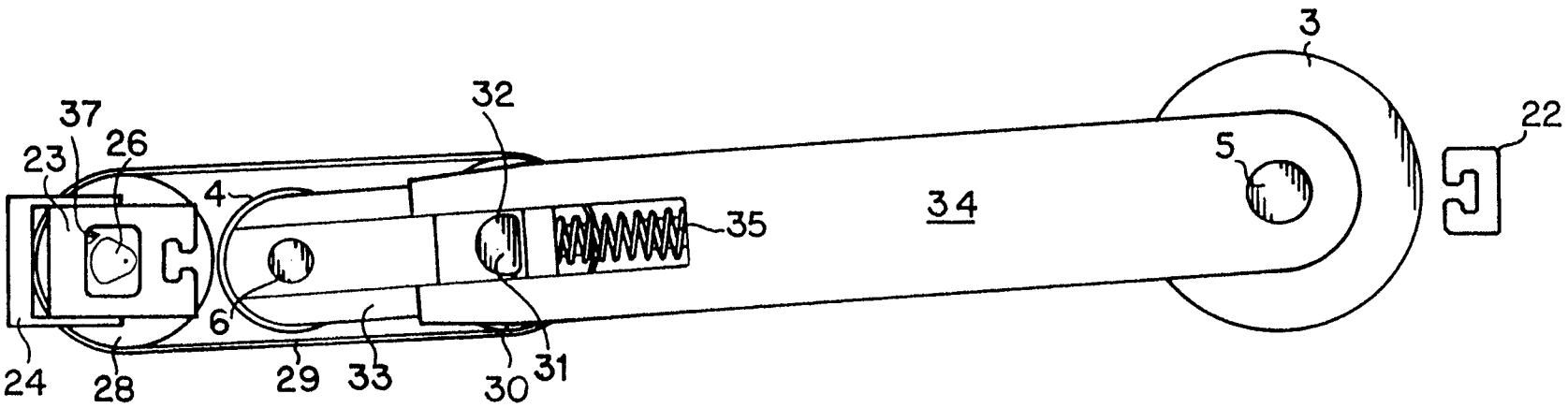
FIG. 12 is a front isometric view of the mechanism for expanding and contracting the shell and the drive and idler roller, without the belt photoconductor installed.

In use, the old belt 1 is first removed from the printer by sliding expandable shell 10 into the printer, with the shell in its extended position, over belt 1, as is particularly shown in FIG. 4A. The housing is guided by rails 21 and shell guides 22 and 23. When fully inserted, shell 10 completely surrounds belt 1 but does not touch it. Belt 1 is then untensioned by moving idler 4 roller towards drive roller 5, as is explained above. As idler roller 4 moves to untension belt 1, shell 10 collapses in unison. This motion causes belt 1 to move from being tensioned on the rollers to being held against the inner wall of shell 10, as is shown in FIG. 4B. Shell 10, with the captured belt, is then pulled from the printer, as is illustrated in FIG. 4C. The old belt photoconductor is removed from shell 10 and replaced with a new belt photoconductor. Shell 10 is then re-inserted into the printer as is shown in FIG. 4D. Belt 1 is then re-tensioned by moving idler roller 4 out and expanding shell 10 in unison, as is shown in FIG. 4E. Shell 10 is then removed from the printer, leaving a new photoconductive belt 1 installed in the printer, as is illustrated in FIG. 4F.

While there is shown and described, the present preferred embodiment of the invention, it is to be distinctly understood that this invention is not limited thereto but may be variously embodied to practice within the scope of the following claims.

What is claimed is:

1. An apparatus for installing and removing a belt photoconductor in and from an image forming device which comprises:

shell means being expandable between an expanded position and a contracted position and having an opening for receiving the belt photoconductor;

the shell means being sized and shaped to loosely conform to the shape of the belt photoconductor when the belt photoconductor is installed in an image forming apparatus and the shell means is in its expanded position;

the shell means being further configured to engage the belt photoconductor when the belt photoconductor is installed in an image forming apparatus and the shell means is in its contracted position; and shell expansion and contraction means for moving the shell means between its expanded and contracted positions.

2. The apparatus of claim 1 wherein the shell means comprises:

a main shell body having a top panel portion, a front panel portion, a bottom panel portion and a rounded end portion; and a second rounded end portion being slidably attached to the main shell body.

3. The apparatus of claim 2 further comprising handle means being attached to the shell means to facilitate placement of the shell means.

4. The apparatus of claim 3 wherein the shell expansion and contraction means comprises:

at least two rail means being attached to the shell means at opposing points generally along a line in the direction of expansion and contraction;

means for receiving, guiding and holding the rail means; and means for changing the distance between the receiving, guiding and holding means.

5. The apparatus of claim 4 wherein the means for receiving, guiding and holding the rail means comprises:

a stationary shell guide including a portion configured to receive and hold the rail means; and a slidable shell guide including a portion configured to receive and hold the rail means.

6. The apparatus of claim 2 wherein the shell expansion and contraction means comprises:

at least two rail means being attached to the shell means at opposing points generally along a line in the direction of expansion and contraction;

means for receiving, guiding and holding the rail means; and means for changing the distance between the receiving, guiding and holding means.

7. The apparatus of claim 1 wherein the shell expansion and contraction means comprises:

at least two rail means being attached to the shell means at opposing points generally along a line in the direction of expansion and contraction;

means for receiving, guiding and holding the rail means; and means for changing the distance between the receiving, guiding and holding means.

8. The apparatus of claim 1 further comprising handle means being attached to the shell means to facilitate placement of the shell means.

* * * * *